US007484392B2

(12) United States Patent
Katagiri

(10) Patent No.: US 7,484,392 B2
(45) Date of Patent: Feb. 3, 2009

(54) CYLINDER LOCK AND KEY

(75) Inventor: Toshiharu Katagiri, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 86 days.

(21) Appl. No.: 11/542,412

(22) Filed: Oct. 3, 2006

(65) Prior Publication Data

US 2007/0074552 A1 Apr. 5, 2007

(30) Foreign Application Priority Data

Oct. 5, 2005 (JP) ..... 2005-292877

(51) Int. Cl.
*E05B 27/00* (2006.01)

(52) U.S. Cl. ..... 70/492; 70/337; 70/406; 70/409; 70/456 R

(58) Field of Classification Search ..... 70/337, 70/340, 456 R, 256, 405–409, 377, 492
See application file for complete search history.

(56) References Cited

U.S. PATENT DOCUMENTS

| | | | | | |
|---|---|---|---|---|---|
| 1,957,851 | A * | 5/1934 | Rubner | 70/340 |
| RE20,865 | E * | 9/1938 | Olson | 70/406 |
| 2,775,884 | A * | 1/1957 | Fresard et al. | 70/492 |
| 2,829,513 | A * | 4/1958 | Fresard et al. | 70/492 |
| 4,075,879 | A * | 2/1978 | Christopher | 70/337 |
| 5,372,024 | A * | 12/1994 | Ruckert | 70/406 |
| 5,561,331 | A * | 10/1996 | Suyama et al. | 307/10.3 |
| 6,308,543 | B1 * | 10/2001 | Yoshizawa | 70/492 |
| 6,968,717 | B2 * | 11/2005 | Suzuki et al. | 70/492 |
| 6,973,814 | B2 * | 12/2005 | Keller | 70/493 |
| 7,240,525 | B2 * | 7/2007 | Sevillano Gil | 70/340 |
| 2004/0237613 | A1 * | 12/2004 | Shimura et al. | 70/456 R |
| 2005/0166650 | A1 * | 8/2005 | Shimura et al. | 70/252 |
| 2005/0223766 | A1 * | 10/2005 | Hashimoto et al. | 70/456 R |
| 2006/0000251 | A1 * | 1/2006 | Ceron et al. | 70/492 |
| 2006/0150696 | A1 * | 7/2006 | Eychenne et al. | 70/456 R |
| 2006/0201216 | A1 * | 9/2006 | Gil | 70/492 |
| 2006/0260370 | A1 * | 11/2006 | Miwa et al. | 70/456 R |

FOREIGN PATENT DOCUMENTS

| | | |
|---|---|---|
| JP | 07-259400 | 10/1995 |
| JP | 2005-226254 | 8/2005 |

* cited by examiner

*Primary Examiner*—Suzanne D Barrett
(74) *Attorney, Agent, or Firm*—Patterson, Thuente, Skaar & Christensen, P.A.

(57) ABSTRACT

A cylinder lock provided with a thick key including an elongated base having two surfaces. A serrated wall extends from one surface of the base. A key groove is formed by the serrated wall. A rib is formed on the other surface of the base. The cylinder lock is further provided with a rotatable rotor including a keyway into which the thick key is inserted. A first cavity is formed in the keyway and shaped to enable insertion of the base of the thick key. A second cavity is formed in the keyway and shaped to enable insertion of the serrated wall of the thick key. A third cavity is formed in the keyway and shaped to enable insertion of the rib of the thick key. The keyway enables insertion of a thin key in lieu of the thick key.

12 Claims, 8 Drawing Sheets

CYLINDER LOCK AND KEY

BACKGROUND OF THE INVENTION

The present invention relates to a cylinder lock and a key for the cylinder lock.

In the prior art, a key with an inner groove may be used for a cylinder lock. Such a key includes an elongated key plate. A key groove, or inner groove, extends in the longitudinal direction of the key plate and is formed between serrated walls in at least one surface of the key plate. Such a key is referred to as an inner groove key (refer to, for example, Japanese Laid-Open Patent Publication No. 7-259400). The inner groove key is difficult to duplicate. Further, a cylinder lock using the inner groove key is resistant to picking. For such reasons, grooved keys are used in various fields.

In recent years, a so-called electronic key system has been proposed to provide a higher level of security and improve convenience (refer to, for example, Japanese Laid-Open Patent Publication No. 2005-226254). In an electronic key system, identification codes are transmitted between a portable device and a locking device to lock and unlock the locking device. The identification codes are authenticated to ensure a high level of security. With the electronic key system, a key does not have to be inserted into a keyway. Due to its convenience, the use of electronic key systems in vehicles and houses has increased dramatically.

In this manner the electronic key system provides both security and convenience at high levels. Nevertheless, it is still desirable for a mechanical key to be on hand just in case the electronic key system fails to function normally for one reason or another (e.g., failure in the electric system or communication system). Accordingly, most portable devices are equipped with an emergency mechanical key. During an emergency, the emergency key is removed from the portable device and used to lock and unlock the locking device.

Based on thickness, portable devices for electronic key systems, which remotely controls locking and unlocking, may be classified into two types, a card-type and a box-type. An emergency key for a card-type portable device must be thin so that it can be accommodated in the portable device. However, it is preferable that the emergency key be thick due to the torque applied when turning the key in the cylinder lock to perform locking or unlocking. Thus, an emergency key for a box-type portable device is thick.

In the prior art, a thick key cannot be inserted into a cylinder lock designed for thin keys. Further, when inserting a thin key into a cylinder lock designed for thick keys, the thin key would be loose in the cylinder lock. This would hinder stable locking and unlocking with the thin key.

Selection of the type of portable device depends on the application or assumed user of the portable device. However, it is desirable that a cylinder lock, or key locking device, be applicable to both thin keys and thick keys. Accordingly, there is a strong demand for the development of such a key locking device.

SUMMARY OF THE INVENTION

The present invention provides a cylinder lock enabling the use of keys having different thicknesses, a key for such a cylinder lock, and a portable device incorporating such a key.

One aspect of the preset invention is a cylinder lock including a first key. The first key includes an elongated base having two opposite surfaces. A serrated wall extends from at least one of the surfaces of the base. A key groove is formed by the serrated wall and extends in a longitudinal direction of the base. A rib is formed on at least one of the surfaces of the base and extends in the longitudinal direction of the base. The cylinder lock further includes a rotatable rotor. The rotor includes a keyway into which the first key is insertable. A first cavity is formed in the keyway and shaped to enable insertion of the base of the first key. A second cavity is formed in the keyway and shaped to enable insertion of the serrated wall of the first key. A third cavity is formed in the keyway and shaped to enable insertion of the rib of the first key. The keyway enables insertion of a key differing from the first key in lieu of the first key.

A further aspect of the present invention is a key for use with a cylinder lock. The cylinder lock includes a rotatable rotor having a keyway into which the key is insertable. The key includes an elongated base having two opposite surfaces. A serrated wall extends from at least one of the surfaces of the base. A key groove is formed by the serrated wall and extends in a longitudinal direction of the base. A rib is formed on at least one of the surfaces of the base and extends in the longitudinal direction of the base.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be discussed with reference to the drawings.

Figure 1:
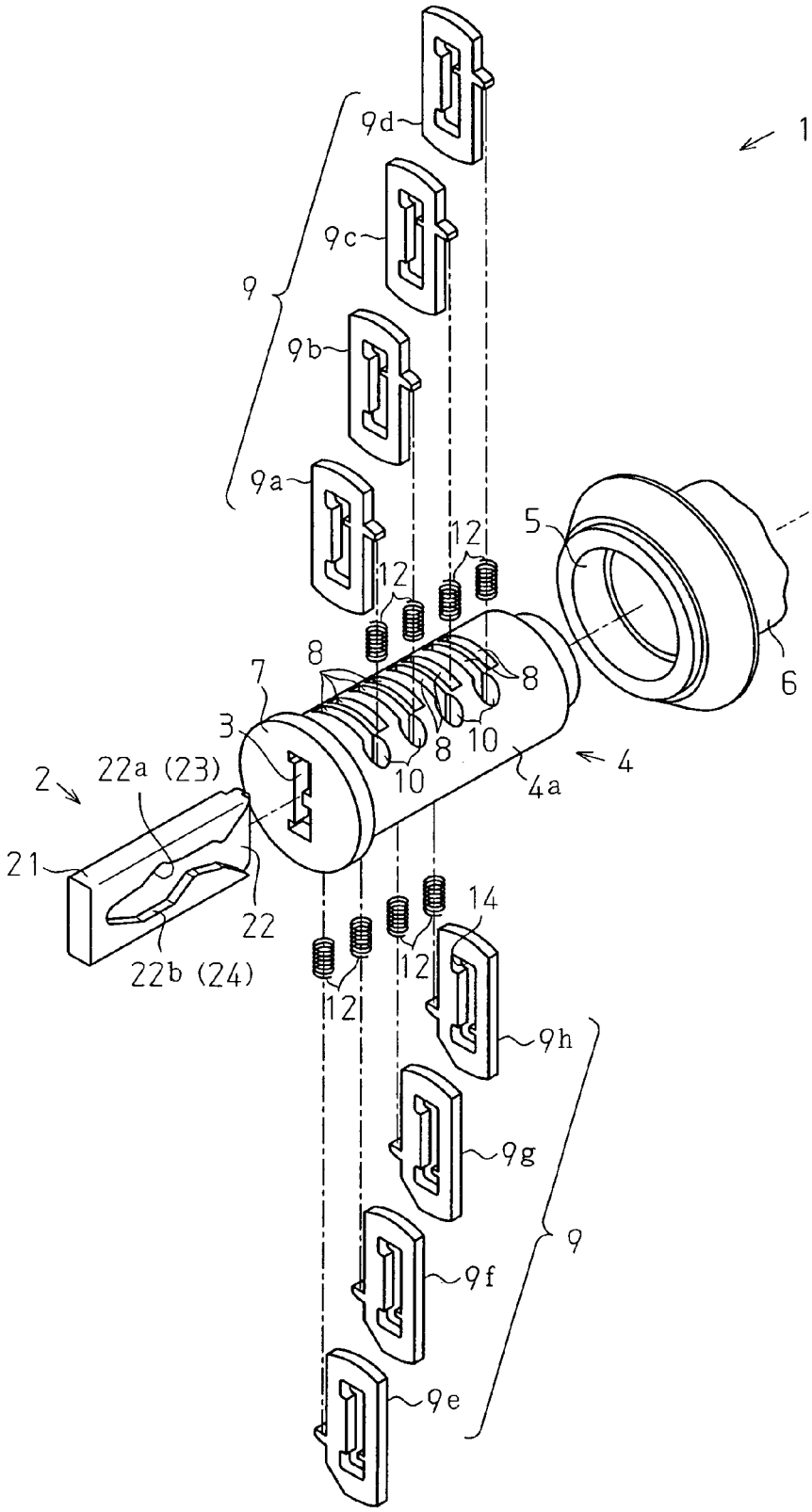
FIG. 1 is an exploded perspective view showing a cylinder lock according to a preferred embodiment of the present invention.
Figure 2:
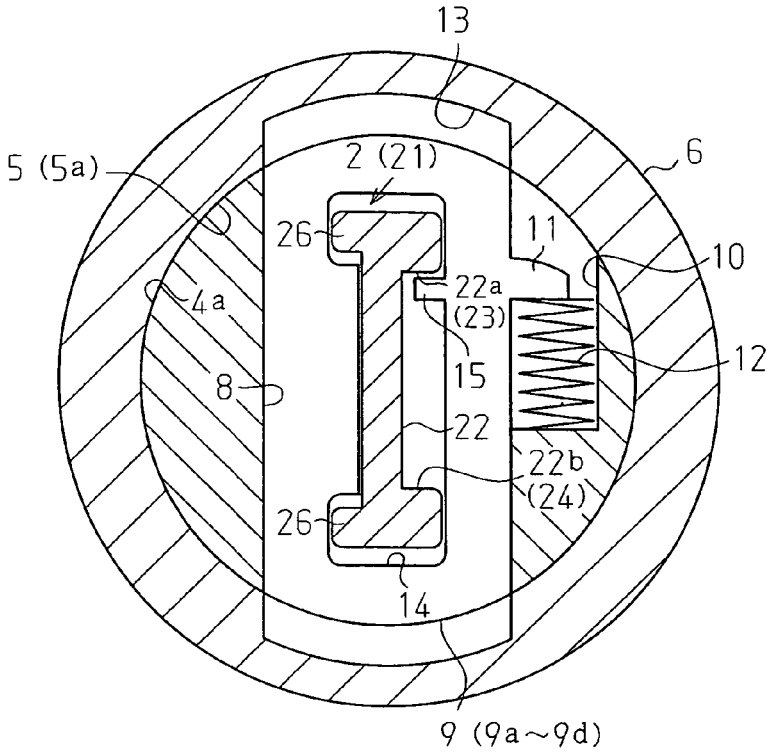
FIG. 2 is a cross-sectional diagram of the cylinder lock.
Figure 3:
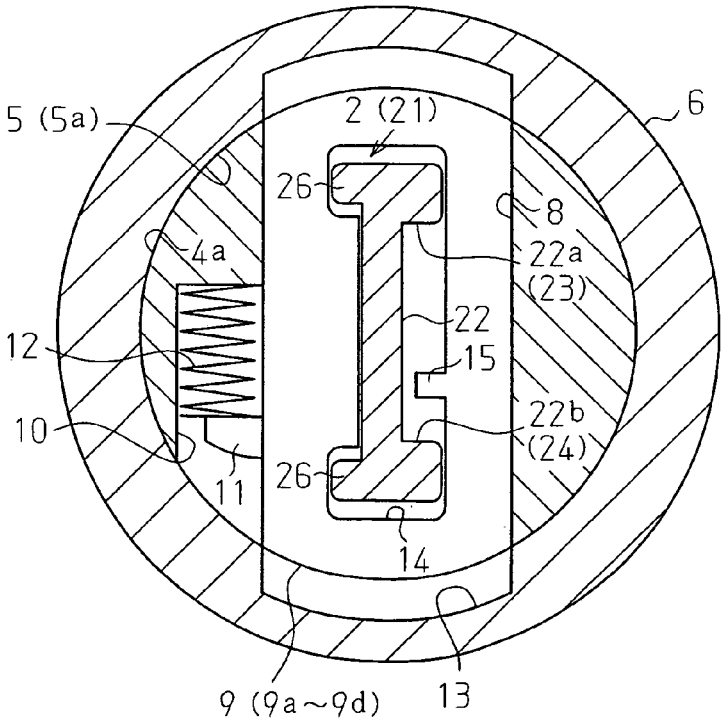
FIG. 3 is a further cross-sectional diagram of the cylinder lock.
Figure 4A:
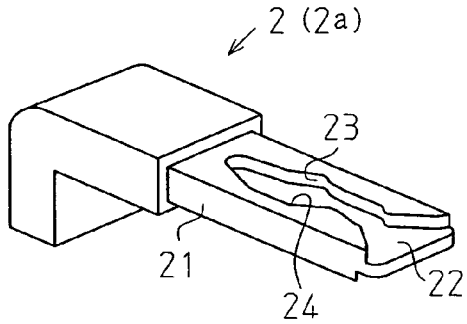
FIG. 4A is a perspective view showing a thick key.
Figure 4B:
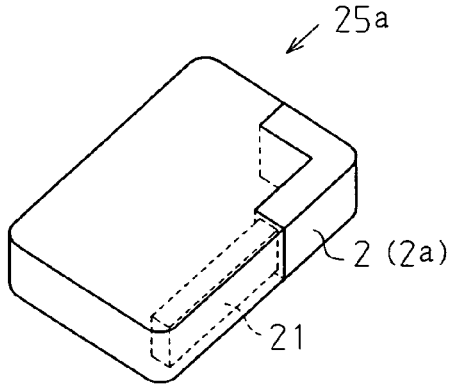
FIG. 4B is a perspective view showing a portable device in a state accommodating the thick key.
Figures 5A, 5B, 5C:
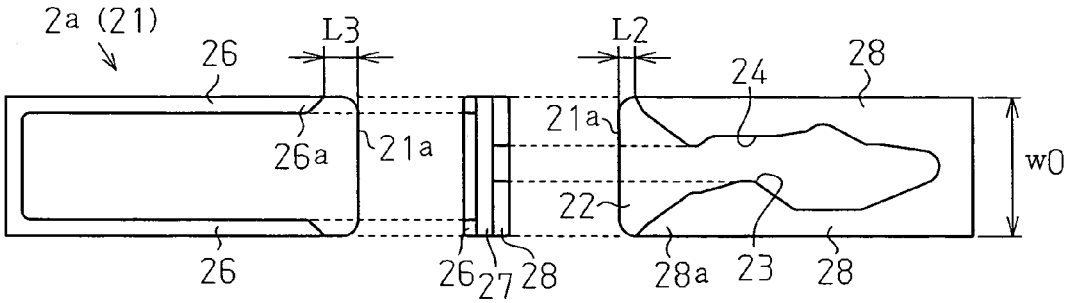
FIG. 5A is bottom view showing a key plate of the thick key.
FIG. 5B is a front view showing the key plate of FIG. 5A.
FIG. 5C is a plan view showing the key plate of FIG. 5A.

With reference to FIGS. 1 to 3, a cylinder lock 1 of the preferred embodiment cooperates with a proper key 2 to perform locking and unlocking. The cylinder lock 1 includes a rotor 4 and a rotor case 6. The rotor 4 has a keyway 3 into which the key 2 is inserted. The rotor case 6 includes a cylinder 5 for rotatably accommodating the rotor 4. The rotor 4 is cylindrical, and the keyway 3 extends axially from an end surface 7 of the rotor 4. The rotor 4 is accommodated in the cylinder 5 in a state in which the end surface 7, which includes the keyway 3, is exposed.

The rotor 4 includes a plurality of tumbler slots 8. The tumbler slots 8 extend radially through the rotor 4. Each tumbler slot 8 receives a plate tumbler 9, which is projectable from the tumbler slot 8. In the preferred embodiment, a spring seat 10 extends from one side of each tumbler slot 8 to receive a coil spring 12. A tab 11 extends from one side of each plate tumbler 9. In each tumbler slot 8, the tab 11 of the plate tumbler 9 is engaged with one end of the corresponding coil spring 12. This urges the plate tumbler 9 in a direction in which it projects out of the tumbler slot 8. The plate tumbler 9 projected out of the tumbler slot 8, that is, out of a circumferential surface 4*a* of the rotor 4, by the elastic force of the coil spring 12 is engaged with an engagement recess 13, which is formed in the wall surface 5*a* of the cylinder 5. This restricts rotation of the rotor 4.

Each plate tumbler 9 has a key receptacle 14, which receives the key 2 when the key 2 is inserted into the keyway 3, and a projection 15, which extends into the key receptacle 14. When the proper key 2 is inserted into the keyway 3, the key 2 engages the projection 15 and moves each plate tumbler 9 into the corresponding tumbler slot 8 against the elastic force of the coil spring 12. When the insertion of the proper key 2 moves each one of the plate tumblers 9 into the circumferential surface 4*a* of the rotor 4, the rotation of the rotor 4 is enabled. In other words, locking and unlocking is enabled.

More specifically, in the preferred embodiment, the key 2 used for the cylinder lock 1 includes an elongated key plate 21, which has a width and a thickness. Two relatively wide surfaces are defined on opposite sides of the key plate 21 in the thicknesswise direction. A key groove 22 extends longitudinally along one of the wide surfaces of the key plate 21. The key groove 22 is formed by two serrated surfaces 22*a* and 22*b*, which engage the projections 15 and move the plate tumblers 9 into the circumferential surface 4*a* of the rotor 4. Accordingly, the serrated surfaces 22*a* and 22*b* function as engagement surfaces 23 and 24.

The key 2 for the cylinder lock 1 in the preferred embodiment is the so-called inner groove key. Thus, the projection 15 of each plate tumbler 9 is set so that when the proper key 2 is inserted into the keyway 3 and located at a predetermined insertion position, the plate tumbler 9 is completely moved into the corresponding tumbler slot 8. As a result, only the proper key 2 enables locking and unlocking with the cylinder lock 1.

In the preferred embodiment, the rotor 4 includes plate tumblers 9*a* to 9*d*, which correspond to the engagement surface 23, and plate tumblers 9*e* to 9*h*, which correspond to the engagement surface 24. Each of the tumblers 9*a* to 9*h* is provided with the tumbler slot 8, the spring seat 10, and the coil spring 12.

In the preferred embodiment, a thick key 2*a* and a thin key 2*b* may both be used as the proper key 2 in the cylinder lock 1. The thick key 2*a* is retained as an emergency key in a box-type portable device 25*a*, which is shown in FIGS. 5A to 5C and 6. The thin key 2*b* is retained as an emergency key in a card-type portable device 25*b*, which is shown in FIGS. 8A to 8C and 9. The portable devices 25*a* and 25*b* are for use in an electronic key system and remotely control locking and unlocking. The thick key 2*a* and the thin key 2*b* have different thicknesses d0.

In the preferred embodiment, the thick key 2*a* differs from the thin key 2*b* in that two ribs 26 extend longitudinally along the surface opposite to the surface of the key groove 22. Thus, the thickness da of the thick key 2*a* is greater than the thickness db of the thin key 2*b* (da>db).

Figure 6:
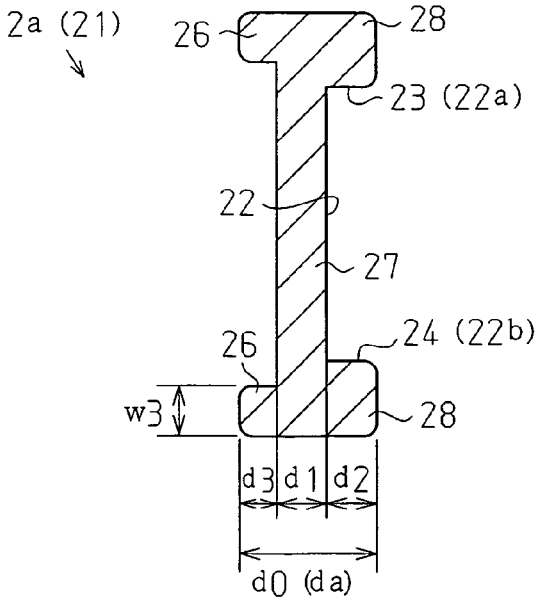
FIG. 6 is a cross-sectional view of the key plate of FIG. 5A.
Figure 7A:
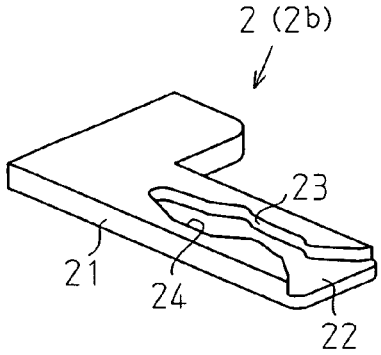
FIG. 7A is a perspective view showing a thin key.
Figure 7B:
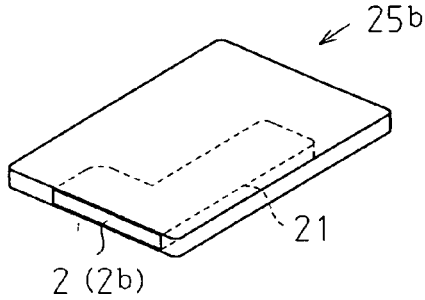
FIG. 7B is a perspective view showing a portable device in a state accommodating the thin key.
Figures 8A, 8B, 8C:
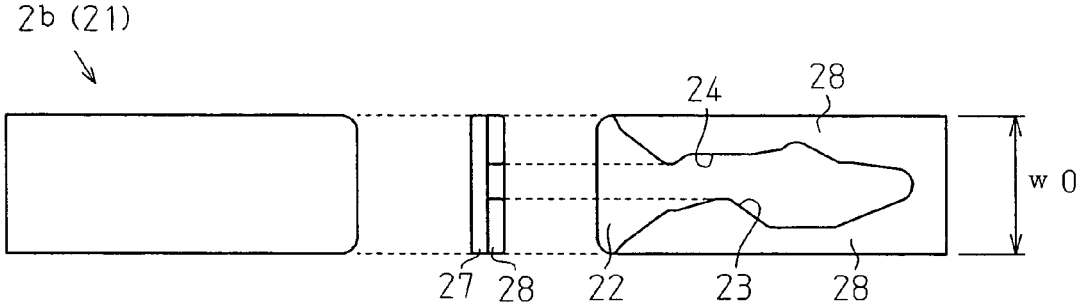
FIG. 8A is bottom view showing a key plate of the thin key.
FIG. 8B is a front view showing the key plate of FIG. 8A.
FIG. 8C is a plan view showing the key plate of FIG. 8A.
Figure 9:
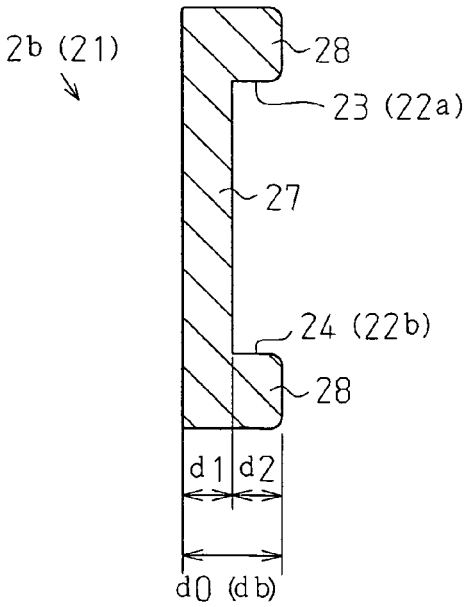
FIG. 9 is a cross-sectional view of the key plate of FIG. 8A.
Figure 10:
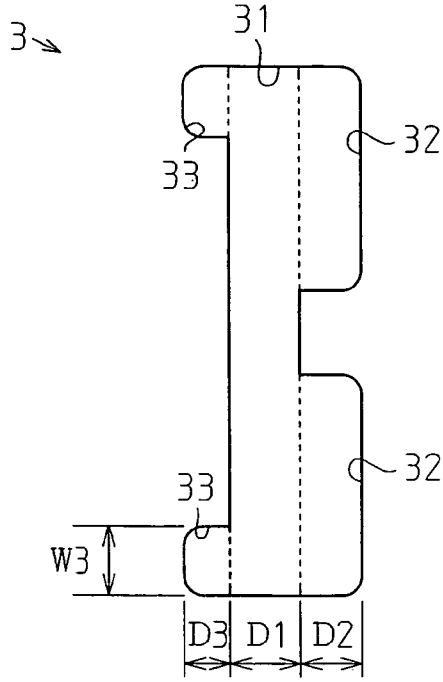
FIG. 10 is a schematic diagram showing a keyway.
Figure 11:
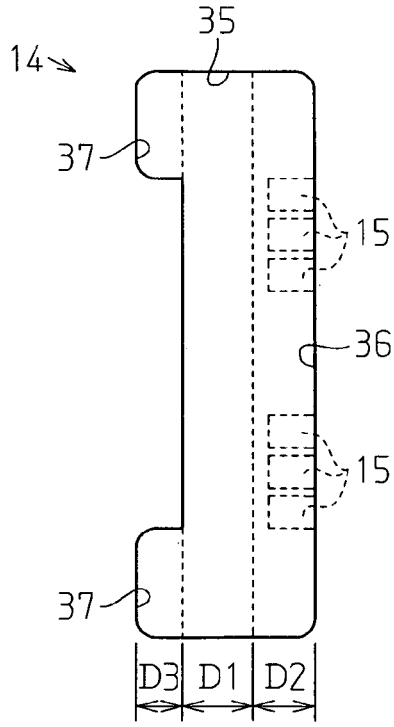
FIG. 11 is a schematic diagram showing a key receptacle.
Figure 12A:
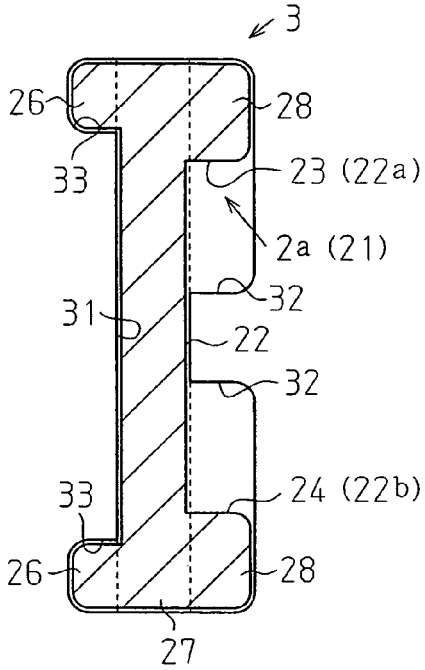
FIGS. 12A and 12B are schematic diagrams showing the keyway in key insertion states.
Figure 12B:
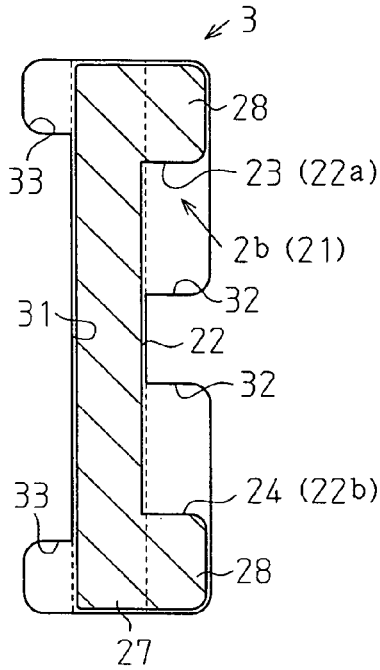
Figures 13A, 13B, 13C:
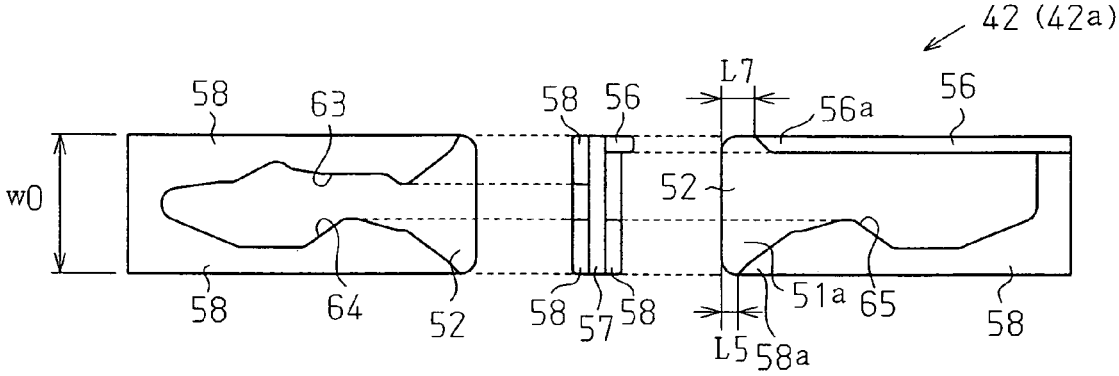
FIG. 13A is bottom view showing a key plate of a thick key according to a further embodiment of the present invention.
FIG. 13B is a front view showing the key plate of FIG. 13A.
FIG. 13C is a plan view showing the key plate of FIG. 13A.
Figures 13D, 13E, 13F:
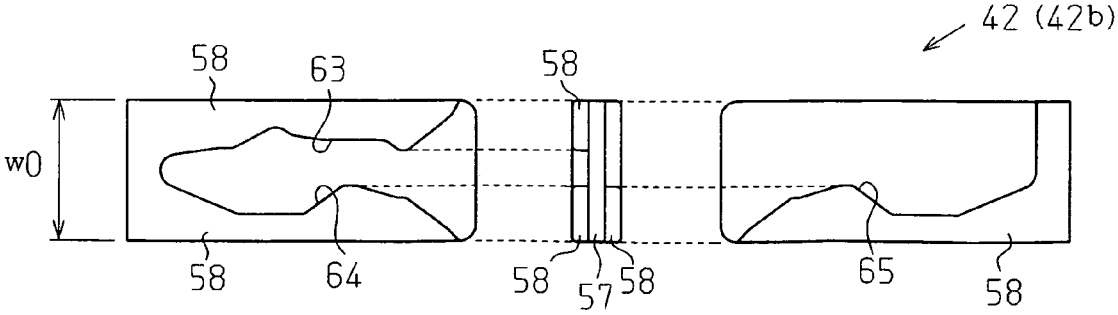
FIG. 13D is bottom view showing a key plate of a thin key in the further embodiment.
FIG. 13E is a front view showing the key plate of FIG. 13D.
FIG. 13F is a plan view showing the key plate of FIG. 13D.
Figure 14A:
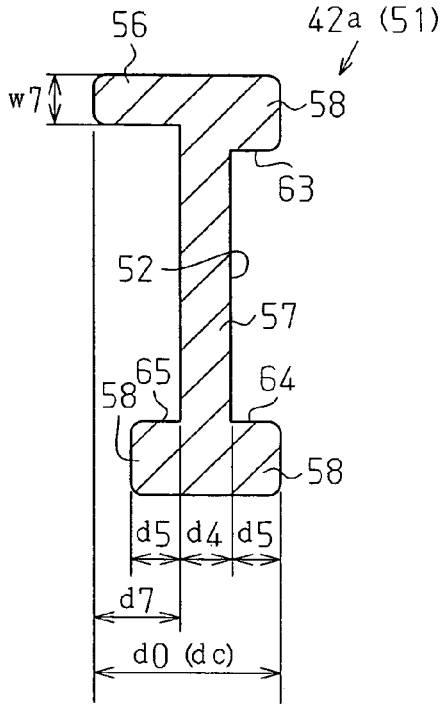
FIGS. 14A and 14B are cross-sectional diagrams respectively showing a key plate of the thick key shown in FIG. 13A and a key plate of the thin key shown in FIG. 13D.
Figure 14B:
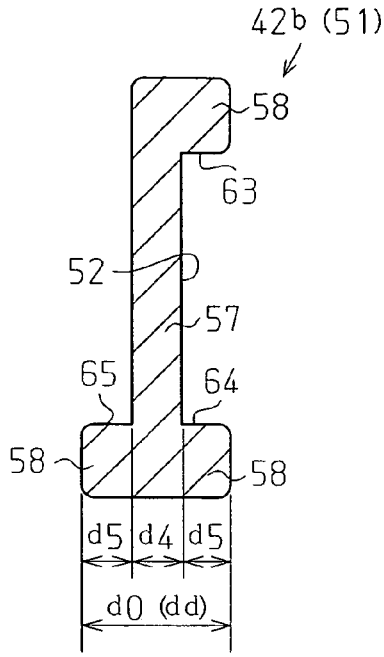

As shown in FIG. 6 and 9, the two types of proper keys 2 (i.e., thick key 2*a* and thin key 2*b*) both include an elongated base 27, which has a rectangular cross-section, and serrated walls 28, which project from the base 27 and form the serrated surfaces 22*a* and 22*b* defining the engagement surfaces 23 and 24 of the key groove 22. The base 27 and the serrated walls 28 of the thick key 2*a* are shaped to be generally identical to the base 27 and the serrated walls 28 of the thin key 2*b*. More specifically, referring to FIGS. 5C, 6, 8C and 9, the thick key 2*a* and the thin key 2*b* are formed so that the key plates 21 have the same width w0, the bases 27 have the same thickness d1, and the serrated walls 28 have the same thickness d2. The serrations on the engagement surfaces 23 and 24 are also shaped to be identical between the thick key 2*a* and the thin key 2*b*.

Each rib 26 of the thick key 2*a* has an end 26*a*, which is located near a distal end 21*a* of the key plate 21. The key 2 is inserted into the keyway 3 from the distal end 21*a* of the key plate 21. Each serrated wall 28 has an end 28*a*, which is also located near the distal end 21*a* of the key 2. The ends 26*a* of the ribs 26 are located farther from the distal end 21*a* of the key plate 21 than the ends 28*a* of the serrated walls 28. Thus, the length L3 from the distal end 21*a* of the key plate 21 to the end 26*a* of each rib 26 is greater than the length L2 from the distal end 21*a* of the key plate 21 to the end 28*a* of each serrated wall 28.

Referring to FIGS. 10 to 12B, in the cylinder lock 1 of the preferred embodiment, the keyway 3 includes a first cavity 31 enabling insertion of the base 27 of the thick key 2*a* and the thin key 2*b*, second cavities 32 enabling insertion of the serrated walls 28 of the thick key 2*a* and the thin key 2*b*, and third cavities 33 enabling insertion of the ribs 26 of the thick key 2*a*. In the preferred embodiment, the ribs 26 of the thick key 2*a* are formed on the surface opposite the key groove 22. Accordingly, the third cavities 33 and the second cavities 32 are formed on opposite sides of the first cavity 31. In the same manner, each plate tumbler 9 includes in the key receptacle 14 a base guide 35 corresponding to the first cavity 31, a serrated wall guide 36 corresponding to the second cavities 32 and including the projection 15, and rib guides 37 corresponding to the third cavities 33. The base guide 35 receives the base 27 of the thick key 2*a* and the thin key 2*b*. The serrated wall guide 36 receives the serrated walls 28 of the thick key 2*a* and the thin key 2*b*. The rib guides 37 receive the ribs 26 of the thick key 2*a*. The first cavity 31 and the base guide 35 each have a dimension D1 in the thicknesswise direction that is substantially the same (slightly greater) as the thickness d1 of the base 27. The second cavities 32 and the serrated wall guide 36 each have a dimension D2 in the thicknesswise direction that is substantially the same (slightly greater) as the thickness d2 of the serrated walls 28.

In the preferred embodiment, each rib 26 of the thick key 2*a* has a thickness (projecting height) d3 that is less than the thickness d2 of the serrated wall 28. Accordingly, the third cavities 33 and the rib guides 37 each have a dimension D3 in the thicknesswise direction that is smaller than the dimension D2 of the second cavities 32 and the serrated wall guide 36. The cylinder lock 1 of the preferred embodiment is formed so that when the key 2 is inserted into the keyway 3 in a reversed state, the third cavities 33 and the rib guides 37 do not permit the insertion of the serrated walls 28. The ribs 26 of the thick key 2*a* each have a width w3 that is set so that the ribs 26 do not engage the projection 15 of each plate tumbler 9.

The preferred embodiment has the advantages described below.

(1) The thick key 2*a* differs from the thin key 2*b* in that the ribs 26 extend longitudinally along the surface opposite the surface of the key groove 22. Thus, the thickness da of the thick key 2*a* is greater than the thickness db of the thin key 2*b* (da>db). Further, the keyway 3 of the cylinder lock 1 includes the first cavity 31, the second cavities 32, and the third cavities 33. The first cavity 31 enables insertion of the base 27. The second cavities 32 enable insertion of the serrated walls 28 projecting from the base 27 and including the serrated surfaces 22*a* and 22*b* of the key groove 22. The third cavities 33 enable the insertion of the ribs 26.

With the above structure, during insertion of the key 2, the base 27 of the key 2 is held in the first cavity 31. Thus, even when the thin key 2*b*, which does not have the ribs 26, is inserted into the keyway 3, the thin key 2*b* is not held loosely and performs stable locking and unlocking. This enables keys of different thicknesses to be used as the proper key. Consequently, the box-type portable device 25*a*, which incorporates the thick key 2*a* as the emergency key, and the card-type portable device 25*b*, which incorporates the thin key 2*b* as the emergency key, may both be used for the cylinder lock 1.

(2) The thick key 2*a* is shaped to increase torsion rigidity while also enabling use of the thin key 2*b* in the cylinder lock 1.

(3) The third cavities 33 and the rib guides 37 are shaped to hinder insertion of the serrated wall 28. This prevents insertion of the key 2 into the keyway 3 in a reversed state.

(4) The end 26*a* of each rib 26 is located farther from the distal end 21*a* of the key plate 21 than the end 28*a* of each serrated wall 28. This prevents insertion of the key 2 into the keyway 3 in a reversed state.

(5) The width w3 of each rib 26 on the thick key 2*a* is set so that the rib 26 does not engage the projections 15 of the plate tumblers 9. This prevents insertion of the key 2 into the keyway 3 in a reversed state.

It should be apparent to those skilled in the art that the present invention may be embodied in many other specific forms without departing from the spirit or scope of the invention. Particularly, it should be understood that the present invention may be embodied in the following forms.

In the preferred embodiment, the present invention is embodied in a lock cylinder and emergency key for an electronic key system. However, the present invention may be embodied in any type of lock cylinder and key.

In the preferred embodiment, the thick key 2*a* includes the ribs 26, which extend longitudinally along the surface opposite to the surface having the key groove 22. Thus, the thickness da of the thick key 2*a* is greater than the thickness db of the thin key 2*b*. However, the present invention may also be applied when both sides of the key plate 21 include a key groove. In this case, a rib is formed on at least one side of the key plate 21.

More specifically, referring to FIGS. 13A to 13F and 14A to 14B, when using two proper keys 42 (42*a* and 42*b*), key grooves 52 are formed in opposite sides of a key plate 51. One side of the key plate 51 includes only one serrated wall 58, and the other side of the key plate 51 includes two serrated walls 58. Each serrated wall 58 has thickness d5. The thick key 42*a* differs from the thin key 42*b* in that the side of the key plate 51 including only one serrated wall 58 additionally includes a rib 56 extending parallel to the serrated wall 58. The rib 56 has a thickness d7, which is greater than the thickness d5 of the serrated walls 58 (d7>d5). Thus, the thick key 42*a* has a thickness dc that is greater than the thickness dd of the thin key 42*b*. The thick key 42*a* and the thin key 42*b* are formed so that the key plates 21 have the same width w0, bases 57 have the same thickness d4, and the serrated walls 58 have the same thickness d5. The serrations of engagement surfaces 63, 64, and 65 are also shaped to be identical between the thick key 42*a* and the thin key 42*b*.

Figure 15A:
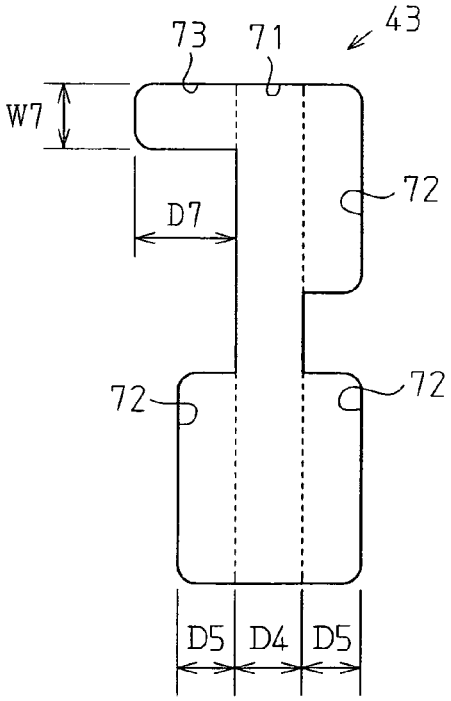
FIGS. 15A and 15B are schematic diagrams respectively showing the shape of a keyway and the shape of a key receptacle in the further embodiment.
Figure 15B:
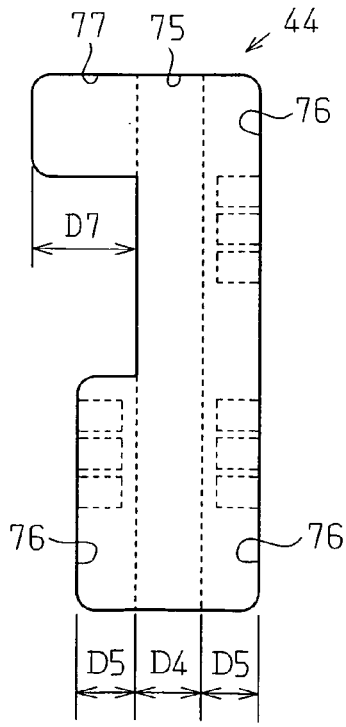
Figure 16A:
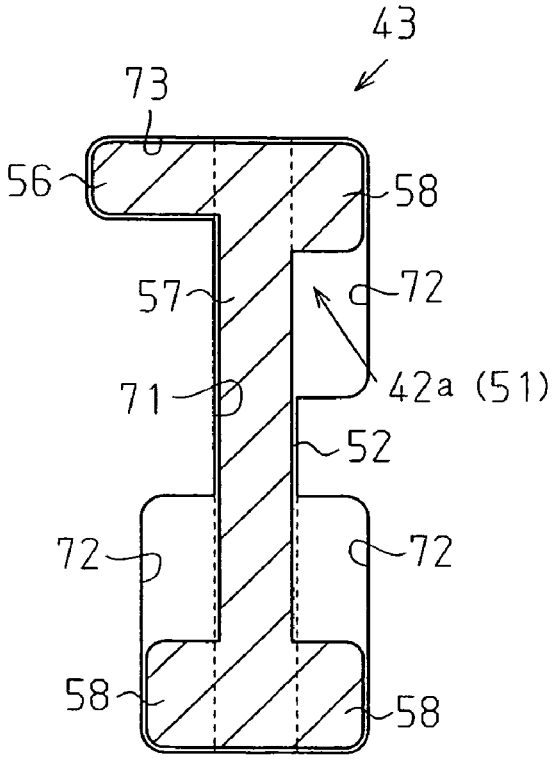
FIGS. 16A and 16B are schematic diagrams respectively showing a keyway in key insertion states in the further embodiment.
Figure 16B:
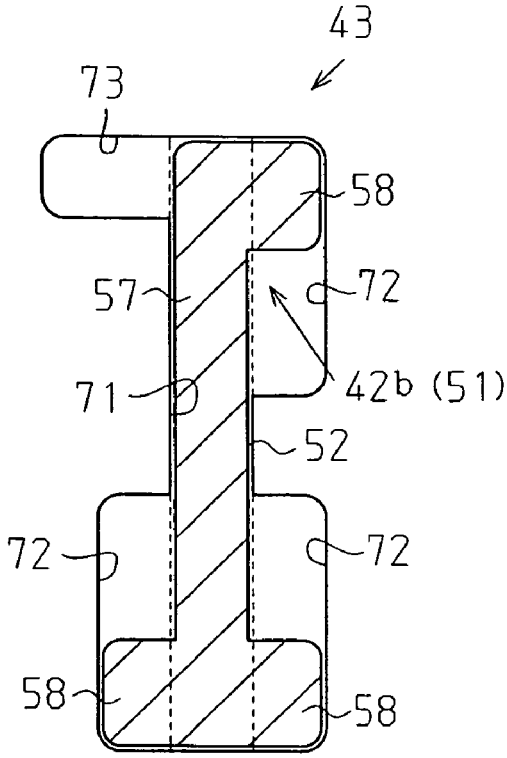

Referring to FIGS. 15A to 15B and 16A to 16B, a cylinder lock has a keyway 43 and key receptacles 44 shaped in accordance with the keys 42*a* and 42*b*. More specifically, as shown in FIG. 15A, the keyway 43 includes a first cavity 71 enabling the insertion of the base 57 of the thick key 42*a* and the thin key 42*b*, second cavities 72 enabling insertion of the serrated walls 58 of the thick key 42*a* and the thin key 42*b*, and a third cavity 73 enabling insertion of the rib 56 of the thick key 42*a*. Further, as shown in FIG. 15B, each key receptacle 44 includes a base guide 75 corresponding to the first cavity 71, serrated wall guides 76 corresponding to the second cavities 72, and a rib guide 77 corresponding to the third cavity 73. The first cavity 71 and the base guide 75 each have a dimension D4 in the thicknesswise direction that is substantially the same (slightly greater) as the thickness d4 of the base 57. The second cavities 72 and the serrated wall guides 76 each have a dimension D5 in the thicknesswise direction that is substantially the same (slightly greater) as the thickness d5 of the serrated walls 58. This enables the use of both of the thick key 42*a* and the thin key 42*b*, which have different thicknesses d0.

The keys 42*a* and 42*b* have the key grooves 52 in two sides. Thus, the keys 42*a* and 42*b* are apt to being inserted into the keyway 43 in a reversed state. Accordingly, the rib 56 of the thick key 42*a* has a thickness (projecting height) d7 that is greater than the thickness d5 of the serrated walls 58. The third cavity 73 and the rib guide 77 each have a dimension D7 in the thicknesswise direction that is larger than the dimension D5 of the second cavities 72 and the serrated wall guides 76. Accordingly, when the thick key 42*a* is inserted into the keyway 3 in a reversed state, the serrated wall 28 cannot be inserted into the third cavity 73 and the rib guide 77. Even if the thin key 42*b* were to be inserted into the keyway 43 in a reversed state, the rib 56 of the thick key 42*a* has a width w3 that is set so that the rib 56 is narrower than the serrated walls 58 and so that the rib 56 does not engage the projection 15 of each plate tumbler 9. Further, the rib 56 is formed so that its end 56*a* is located farther from a distal end 51*a* of the key plate 51 than ends 58*a* of the serrated walls 58. Thus, the length L7 from the distal end 51*a* of the key plate 51 to the end 56*a* of each rib 56 is greater than the length L5 from the distal end 51*a* of the key plate 51 to the end 58*a* of each serrated wall 58.

In the present invention, the keyway 3 does not necessarily have to extend through the rotor 4 and may extend, for example, up to only an intermediate portion of the rotor 4.

In the preferred embodiment, the third cavities 33 are shaped to prevent insertion of the serrated walls 28. However, the second cavities 32 may be formed to prevent insertion of the ribs 26.

The present examples and embodiments are to be considered as illustrative and not restrictive, and the invention is not to be limited to the details given herein, but may be modified within the scope and equivalence of the appended claims.

What is claimed is:

1. A cylinder lock and key system comprising:

a first key including;

an elongated base having two opposite surfaces;

a serrated wall extending from at least one of the surfaces of the base;

a key groove formed by the serrated wall and extending in a longitudinal direction of the base; and a rib formed on at least one of the surfaces of the base and extending in the longitudinal direction of the base;

a second key that differs from the first key, the second key including:

a base shaped identically to that of the first key; and a serrated wall defining a key groove, the serrated wall and the key groove of the second key being shaped identically to the serrated wall and the key groove of the first key; and a rotatable rotor including:

a keyway into which the first key and the second key are selectively insertable;

a first cavity formed in the keyway and shaped to enable insertion of the base of the first key and the base of the second key;

a second cavity formed in the keyway and shaped to enable insertion of the serrated wall of the first key and the serrated wall of the second key; and a third cavity formed in the keyway and shaped to enable insertion of the rib of the first key.

2. The cylinder lock according to claim 1, wherein the third cavity is shaped to prevent insertion of the serrated wall.

3. The cylinder lock according to claim 1, wherein the second cavity is shaped to prevent insertion of the rib.

4. The cylinder lock according to claim 1, wherein:

the key groove is formed on one of the surfaces of the base;

the rib is formed on the surface of the base opposite the key groove;

and the third cavity and the second cavity are formed on opposite sides of the first cavity.

5. The cylinder lock according to claim 1, wherein the first key has an end for inserting first into the keyway, with the end spaced from the rib by a distance that is greater than that from the end to the serrated wall.

6. The cylinder lock according to claim 1, further comprising:

a plate tumbler projecting from the rotor, supported to be movable into the rotor, and arranged in the keyway, wherein the plate tumbler engages the first key or second key that is inserted into the keyway to enable rotation of the rotor, wherein the plate tumbler includes:

a key receptacle in communication with the keyway;

a projection arranged in the key receptacle and engaged with the serrated wall to move the plate tumbler into the rotor when the first key or the second key is inserted into the keyway;

a base guide arranged in the key receptacle in correspondence with the first cavity and receiving the base when the first key or the second key is inserted into the keyway;

a serrated wall guide including the projection, arranged in the key receptacle in correspondence with the second cavity, and receiving the serrated wall when the first key or the second key is inserted into the keyway;

and a rib guide arranged in the key receptacle in correspondence with the third cavity and receiving the rib when the first key is inserted into the keyway.

7. The cylinder lock according to claim 6, wherein the rib has a predetermined width determined to prevent engagement between the rib and the projection.

8. The cylinder lock according to claim 1, wherein at least one of the first key and the second key is accommodated in a portable device for an electronic control system that remotely controls locking and unlocking.

9. A key for use with a cylinder lock, the cylinder lock including a rotatable rotor having a keyway into which the key is insertable, the key comprising:

an elongated base having two opposite surfaces;

a serrated wall extending from at least one of the surfaces of the base;

a key groove formed by the serrated wall and extending in a longitudinal direction of the base;

a rib formed on at least one of the surfaces of the base and extending in the longitudinal direction of the base; and an end for inserting first into the keyway, the end spaced from the rib by a distance that is greater than that from the end to the serrated wall.

10. The key according to claim 9, wherein:

the key groove is formed on one of the surfaces of the base;

and the rib is formed on the surface of the base opposite the key groove.

11. The key according to claim 9, wherein the rib has a width differing from that of the serrated wall.

12. The key according to claim 9, wherein the key is accommodated in a portable device for an electronic control system that remotely controls locking and unlocking.

* * * * *